United States Patent [19]

Bondar

[11] Patent Number: 4,460,809

[45] Date of Patent: Jul. 17, 1984

[54] PROCESS AND DEVICE FOR CONVERTING A PERIODIC LF ELECTRIC VOLTAGE INTO SOUND WAVES

[76] Inventor: Henri B. Bondar, 314 rue Félix Piat, 13300 - Salon de Provence, France

[21] Appl. No.: 377,416

[22] Filed: May 12, 1982

[30] Foreign Application Priority Data

May 21, 1981 [FR] France ..... 81 10386

[51] Int. Cl.[3] ..... H04R 19/02

[52] U.S. Cl. ..... 179/113; 179/111 R

[58] Field of Search ..... 179/113, 111 R

[56] References Cited

U.S. PATENT DOCUMENTS

| | | | |
|---|---|---|---|
| 1,758,993 | 5/1930 | Wolff | 179/113 |
| 3,018,394 | 1/1962 | Brown | 310/5 |
| 3,476,887 | 11/1969 | Seligson et al. | 179/113 |
| 4,308,431 | 12/1981 | Hanbicki | 179/111 R |

FOREIGN PATENT DOCUMENTS

| | | |
|---|---|---|
| 1041790 | 6/1953 | France . |
| 7330746 | 4/1975 | France . |
| 265958 | 1/1928 | United Kingdom . |

OTHER PUBLICATIONS

G. Shirley, "The Corona Loudspeaker", *Radio and Television News,* Oct. 1956, pp. 57–59.

*Primary Examiner*—A. D. Pellinen
*Assistant Examiner*—L. C. Schroeder
*Attorney, Agent, or Firm*—Fisher, Christen & Sabol

[57] ABSTRACT

A process and a device for converting a periodic LF voltage into sound waves, or vice versa. The electro-acoustic transducer device has two groups of substantially parallel points which are separated by insulating screens. The points of each group are respectively connected to the positive terminal and to the negative terminal of a source of DC voltage, of the order of 10,000 volts, which renders the points emitters of an ion plasma. The DC voltage is modulated by a periodic LF voltage. The ion plasma oscillates and creates sound waves which analogically reproduce the LF voltage. This technology is particularly applicable to the construction of loud-speakers.

13 Claims, 4 Drawing Figures

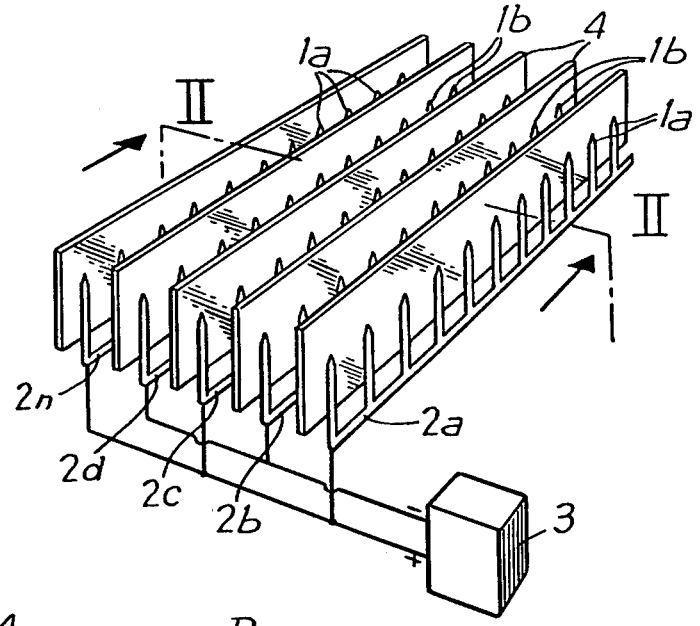
Fig. 1
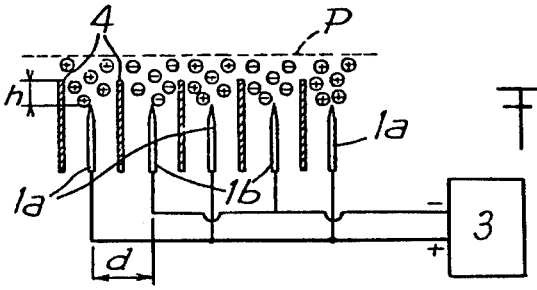
Fig. 2
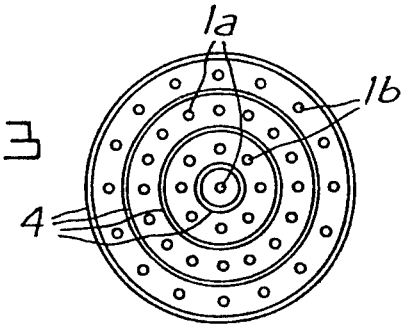
Fig. 3
Fig. 4
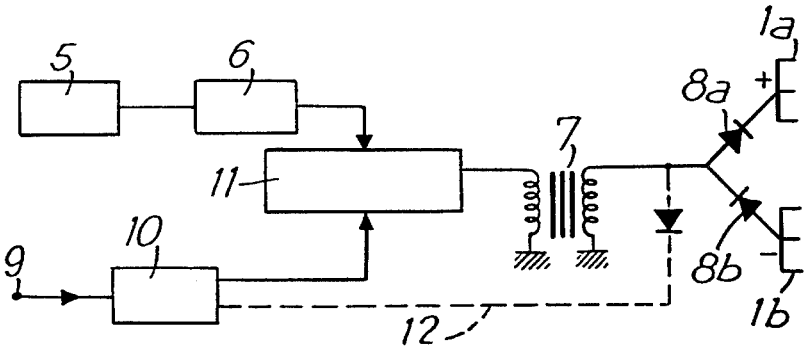

PROCESS AND DEVICE FOR CONVERTING A PERIODIC LF ELECTRIC VOLTAGE INTO SOUND WAVES

BACKGROUND OF THE INVENTION

1. Field of the Invention

The present invention relates to a process and device for converting a periodic LF voltage into sound waves, or vice versa.

2. Prior Art

The technical sector of the invention is that of the construction of electro-acoustic transducer devices, particularly loud-speakers.

It has already been proposed to use plasma, i.e. ionized gases, electrically vibrated to convert electric signals, analog of acoustic signals, into sound waves.

French Pat. No. 1,041,790 (Siegfried KLEIN) describes a device for converting a voltage into a sound or ultra-sonic wave.

This device comprises a hot electrode, for example a platinum point, which is subjected to a high frequency AC voltage, of the order of 20,000 volts, and which heats a refractory tube surrounding the electrode, which is coated with an ion-emitting layer.

French Pat. No. 73 30746 (Henri DOUCET) describes loud speakers incorporating plasma which comprise an ion source constituted by a wire taken to high voltage. This wire is placed in a low frequency AC electric field; low frequency modulation is effected for example by two flat electrodes placed on either side of the wire which are taken to a high potential at low frequency.

The so-called "point effect" phenomenon is known, whereby, if a conducting point is taken to a high potential, an electric field is created around the end of the point which is all the more intense as the end of the point has a small radius of curvature.

For a determined point, when the value of the voltage exceeds a threshold, there is ionization of the molecules of the air, particularly the molecules of oxygen. The point becomes ionizing by field effect The ions created by the point are of the same sign as the latter and they are therefore repelled thereby, whatever the sign of the voltage.

For the ionizing activity of the points to be maximum, i.e. for the quantity of ions created by a point to be as large as possible, the ions created in the vicinity of a point must be evacuated, otherwise the potential of the air which envelops the point rises and it tends to take a value close to that of the point, this reducing the electric field and the emission of ions.

BROAD DESCRIPTION OF THE INVENTION

It is an object of the present invention to provide new electro-acoustic transducer means, i.e. means for converting periodic voltages into sound waves and vice versa, by means of an ion plasma, which are of higher performance than the known devices of this type.

This object is attained by a process according to which:

an ion plasma is created by means of a plurality of substantially parallel sharp points, which are taken to potentials, of different polarity, which are sufficiently high to render them ion-emitting by field effect.

and, either the ionization potential applied to the points is modulated by a low frequency voltage which analogically represents sound waves, so that said ion plasma oscillates at the frequency of the modulating voltage and emits sound waves, or, inversely, sound waves are applied on the ion plasma, so that the ionization potential of the points is modulated by a low frequency voltage which analogically reproduces the sound waves.

An electro-acoustic transducer device according to the invention comprises:

a plurality of sharp points which are disposed substantially parallel to one another;

means for taking said points to potentials of opposite polarity and sufficiently high for said points to emit ions;

and means for modulating the voltage applied to said points by an AC voltage of acoustic frequency or means for collecting a LF voltage when sound waves are applied to the ion plasma.

The points are preferably connected respectively to the positive terminal and to the negative terminal of a source of DC voltage which is modulated by a low frequency voltage.

Insulating screens are advantageously inserted between the rows of points of opposite polarity, parallel thereto; the length of these screens is greater than the width of the points and the screens project beyond the ends of the points.

The electro-acoustic transducer devices according to the invention are of the type in which an ionized plasma is created which constitutes a sort of intangible diaphragm and the latter is vibrated by means of an AC voltage of acoustic frequency which communicates a vibration of the same frequency to the plasma and to the air which surrounds it and which produces a sound wave or vice versa.

The invention results in new electro-acoustic transducers which may be used as loud-speakers and as ultrasound or infrasound generators and vice versa as microphones or hydrophones.

The loud-speakers according to the invention have a very broad pass band ranging from infrasound to ultrasounds. They have a good linearity in an extensive signal amplitude range. They enable very pure sounds to be obtained and may equip high fidelity chains. Harmonic distorsions and phase deviations of the transducers according to the invention are very slight. All the distorsions and other defects due to the transverse deformations of the loud-speaker diaphragms are eliminated.

The loud-speakers according to the invention may be constructed in very varied shapes and sizes. In particular, extra-flat loud-speakers and large-surface loud-speakers may be constructed without any of the limitations usually imposed by the diaphragms.

With respect to the loud-speakers incorporating plasma which are already known, the transducers according to the invention present advantages due to the use of two groups of points of opposite polarities.

With respect to the loud-speakers proposed by KLEIN, they present the advantage of not comprising parts taken to high temperature. With respect to the loud-speakers proposed by H. DOUCET, they present the advantage that the ionization voltage is directly modulated by the low frequency, this leading to simpler apparatus. Moreover, in the transducers according to the invention, the ions of opposite polarity recombine and do not create electric charges in the vicinity.

BRIEF DESCRIPTION OF THE DRAWINGS

The invention will be more readily understood on reading the following description of embodiments of loud-speakers or electro-acoustic transducers according to the invention, with reference to the accompanying drawings, in which:

FIG. 1 is a partial view in perspective of a loud speaker according to the invention.

FIG. 2 is a transversal section along II—II of FIG. 1.

FIG. 3 is a front view of a variant embodiment of a loudspeaker according to the invention.

FIG. 4 is a diagram of an embodiment of the circuits and electronic components supplying a loud-speaker according to the invention.

DETAILED DESCRIPTION OF THE INVENTION

It is a general object of the invention to provide electroacoustic transducers intended to convert low frequency AC voltages into sound waves which may be sound, ultrasonic or infrasonic waves.

In the following specification, loud-speakers will be described more particularly, but it is specified that this choice does not exclude applications in the domain of the production of ultrasonic or infrasonic sound waves.

The transducers according to the invention are reversible, i.e. if they receive sound waves, they may convert them into electric signals and the invention is also applied to sound wave receiving transducers such as microphones and hydrophones.

Referring now to the drawings, FIG. 1 is a partial perspective view of a loud-speaker according to the invention. It comprises rows of points 1*a*, 1*b*. Points are understood to mean bodies presenting a sufficiently sharp end or edge to produce, by an electric field effect, ionization of a gas in which the points are placed, said gas being for example the ambient air.

For example, the points 1 may be pins or needles or blades of stainless steel or of any other metal which is preferably stainless, to avoid too rapid wear.

In the example shown, all the points 1*a*, 1*b* are parallel and all the ends are in the same plane. It is specified that the ends of the points could also be disposed on a curved surface to improve the directivity of the sound waves.

In the example of FIG. 1, all the points of the same row are connected together by their base and form combs 2*a*, 2*b* . . . 2*n*.

The distance between points in the same row is for example of the order of a few millimetres. However, it is specified that the rows of points, particularly the rows of points of positive polarity, may be continuous and be replaced by thin blades, of the razor blade type, having a sharp upper edge, or by very fine filaments which also produce ionization of the gases by electric field effect.

FIG. 1 shows a source of voltage 3, for example a source of D.C. voltage of the order of ten thousands volts.

Some of the successive combs 2*a*, 2*b* . . . 2*n*, are connected to the negative terminal and the others to the positive terminal of the source 3, so that the points of each row are taken to the same potential and the points of two adjacent rows are taken to opposite potentials. 1*a* will designate the group of points of positive polarity and 1*b* the group of negative polarity.

The potentials with respect to the potential of the ambient gas are sufficiently high for the points to be rendered ionizing by electric field effect. The ionization potential depends on the nature, pressure and temperature of the ambient gas and on the radius of curvature of the end of the points. For example, if steel dress-making pins placed in the air are used as points, the air is ionized by using a source 3 which delivers a D.C. voltage of the order of 10,000 V.

Of course, the ionization voltage must remain lower than the disruptive voltage between points of opposite polarity, which depends on the distance d between rows of points. For a distance d of 1 cm between rows of points placed in the dry air, the disruptive voltage is of the order of 30,000 V.

The positive or negative points produce ions of the same sign which are repelled by the points and which form a plasma of positive and negative ions in front of them.

Due to the use of points of opposite polarity, the ions of opposite polarity recombine when they meet one another and accumulation of ions at a certain distance from the points is avoided.

FIG. 1 also shows insulating screens 4 which are inserted between the rows of points of opposite polarity. The screens 4 are composed for example of plates of insulating plastics material.

The screen is preferably coated with a thin layer of a material having electrical properties close to those of air, for example a layer of polymerisable resin, which avoids an accumulation of charge against the walls of the screen.

The screens 4 are longer than the points 1, with the result that they slightly project beyond the ends of said points.

FIG. 2 shows a transverse section along II—II of FIG. 1. This Figure shows that the screens 4 pass beyond the plane of the points 1 by a length h. The length h may be included between a lower limit close to zero and an upper limit which is of the order of several times the distance d between adjacent points of opposite polarity. For example, h is of the order of d.

FIG. 2 schematically shows the plasma of positive and negative ions which extends up to a limit P shown in dashed lines, beyond which the ions of opposite sign are virtually all recombined.

The presence of an insulating screen 4 between the points of opposite polarity makes it possible to use a higher ionization voltage without disruption of the air, and therefore enables a denser plasma to be obtained. However, the ionization voltage remains limited by the disruptive voltage of the insulation as well as by electrostatic phenomena such as the production of brush discharges or microdischarges.

On a prototype composed of steel dress-making needles, the distance d between rows of points of opposite polarity is of the order of 5 mm. However, by using sharper points, having a radius of curvature of the order of a few microns, like the points used in electron or ion guns, it is possible to use a weaker ionization voltage and to bring the rows of points of opposite polarity closer, by placing them at a distance of the order of a millimetre, which enables a denser plasma to be obtained.

The source of voltage 3 shown in FIG. 1 and 2 is a source of DC voltage intended to create the ion plasma.

To produce sound waves, a LF modulation voltage which analogically reproduces sound waves, is superposed on the ionization voltage. This modulation voltage periodically varies the potential of the points and this variation in potential communicates to the ion plasma oscillations which create in the ambient gas sound waves which analogically reproduce the periodic modulation voltage.

The movements of plasma and the variations in pressure are obtained by collision of the ions on the molecules. There is a transfer of kinetic energy between the accelerated ions and the air molecules.

Inversely, if, after having applied the ionization voltage on the points, air vibrations are provoked by sound waves and are transmitted to the plasma, the displacements of the plasma bring about a modification of the electric field and the voltage of the points, and a modulation of the ionization voltage is obtained, so that an electro-acoustic device according to FIG. 1 is reversible and it may serve as loud-speaker or, inversely, as microphone FIGS. 1 and 2 show a preferred embodiment in which the ionization voltage furnished by the source 3 is a DC voltage. It is specified that the ionization voltage may be a high frequency discontinuous unidirectional voltage. However, the best results are obtained by using a DC ionization voltage.

FIG. 3 shows a front view of another embodiment of a transducer according to the invention, in which the points 1*a*, 1*b* are disposed in concentric circles and are separated by concentric insulating screens 4.

It is specified that it is not necessary for the number of points to be the same for the two polarities. Advantageously, the distance between positive points is smaller than the distance between negative points.

The points and the screens which separate them may be disposed in various configurations, for example in curved or winding lines or in quincunx or zig-zag.

FIG. 4 is a diagram of an embodiment of the circuits and electronic components supplying a loud-speaker according to the invention.

These circuits comprise a high frequency oscillator 5, for example a bistable multivibrator which emits for example a voltage having a frequency of the order of a hundred KHz. The output of the oscillator 5 is connected to a high frequency power amplifier 6 which delivers a voltage of a few tens of volts. The output of the amplifier 6 is connected to a modulator 11 whose output is connected to the primary winding of a transformer 7 which delivers to the secondary winding a very high modulated voltage, of the order of 10,000 to 20,000 volts. The very high voltage is rectified by a rectifier which is shown in a form schematized by diodes 8*a* , 8*b* .

The positive output terminal of the rectifier is connected in parallel to the rows of points 1*a* of the loud-speaker, whilst the negative terminal of the rectifier is connected in parallel to the rows of points 1*b* of the loud-speaker.

Points 1*a* and 1*b* are thus taken to a DC potential which provokes the creation of an ion plasma in front of the points.

The terminal 9 represents the input of the LF signals which analogically represent sounds and which come for example from a microphone, a receiving antenna, a pick-up arm of a record player, a pick-up head of a tape recorder, etc . . .

Reference 10 represents a LF amplifier and reference 11 a modulator which mixes the LF with the HF, so that the points 1*a* and 1*b* are subjected to a DC ionization voltage which is modulated by a LF voltage.

The rectifier 8*a* , 8*b* comprises low pass band filtering means which stop the high frequency and allow the low frequency to pass.

The points of opposite polarity separated by insulating screens form capacitors which filter the signals at very high frequency.

The HF power amplifier 6 may operate in switching mode in order to limit the dissipation of heat.

The diagram of FIG. 4 comprises a negative feedback loop 12 which connects the secondary winding of the transformer 7 to the LF amplifier. This negative feedback enables the distorsion due to the non-linearity of the modulator 11 and of the very high voltage transformer 7 to be corrected.

Of course, the electronic circuits used may have a different configuration from that of FIG. 4 which has been given only by way of example.

For example, LF modulation may be applied directly on the DC voltage at the output of the rectifier 8*a*, 8*b*.

The transducers according to the invention may advantageously replace known loud-speakers, in the domain of high fidelity. The sounds obtained are very pure sounds. The phase deviations according to the frequencies and the phenomena of harmonic distorsions are much reduced.

Compared with the known loud-speakers with diaphragm, the loudspeakers according to the invention have the advantage of a very wide pass band, ranging from the infrasounds to the ultrasounds, with a very flat response curve as a function of the frequency.

The distorsions due to the non-linear deformations of the diaphragm are eliminated. The acoustic power radiated per surface unit is greater in the low-pitched sounds as the loud-speaker according to the invention are equivalent to loud-speakers whose diaphragm has a considerable stroke.

The loud-speakers according to the invention may present very varied forms depending on the applications thereof. They make it possible to construct extra-flat loud-speakers, very large surface loud-speakers, high power loud-speakers of very small surface, directive loud-speakers, etc . . .

The transducers according to the invention may also serve as ultrasound or infrasound generators.

They may be used in particular for constructing antennas for emitting ultrasounds in water. In this case, the points are placed in a box filled with gas which is insulated from the water by a deformable diaphragm which transmits to the water the ultrasonic waves which are communicated to the gas by the ion plasma.

Inversely, transducers according to the invention may also be used as hydrophones.

It is advantageous to provide resistors (not shown) in series with the points, so as to eliminate the possibility of arcing. Moreover, the plates 4 may have advantageous profiles from the aerodynamic point of view of the movements of the plasma.

What is claimed is:

1. Electro-acoustic transducer device comprising:

(a) a first assembly of elements with each having a sharp end;

(b) means for taking said first assembly to a potential sufficiently high so as to render the elements of said first assembly into a state whereby said elements of said first assembly emit ions of one polarity;

(c) a second assembly of elements with each having a sharp end;

(d) means for taking said second assembly to a potential sufficiently high so as to render the elements of said second assembly into a state whereby said elements of said second assembly emit ions of the other polarity;

(e) said first and second assemblies being arranged parallel and near of each other with all of the sharp ends of said elements directed to the same side so that an ion plasma is produced between the elements of said first assembly and the elements of said second assembly; and (f) means for modulating the potential difference applied to elements of said first and second assemblies by a low frequency voltage which analogically represents sound waves so that said ion plasma oscillates at the frequency of the modulating voltage and emits sound waves.

2. Electro-acoustic transducer device as claimed in claim 1 wherein said first assembly of elements with each having a sharp end are points, blades of filaments.

3. Electro-acoustic transducer device as claimed in claim 1 wherein said second assembly of elements with each having a sharp end are points, blades or filaments.

4. Electro-acoustic transducer device as claimed in claim 1 wherein said first and second assemblies each comprise a plurality of elongated curved or linear sub-assemblies of said elements each having a sharp end, a sub-assembly of one of said assemblies being disposed between two sub-assemblies of the other of said assemblies.

5. Electro-acoustic transducer device as claimed in claim 1 wherein said potential difference is supplied by a DC voltage source constituted by a rectifier which is connected to the secondary winding of a very high voltage transformer whose primary winding is supplied by a HF amplifier, which is supplied by an oscillator, and the Hf voltage is modulated by a LF voltage delivered by a LF amplifier.

6. Electro-acoustic transducer device comprising:

(a) a first assembly of elements with each having a sharp end;

(b) means for taking said first assembly to a potential sufficiently high so as to render the elements of said first assembly into a state whereby said elements of said second assembly emit ions of one polarity;

(c) a second assembly of elements with each having a sharp end;

(d) means for taking said second assembly to a potential sufficiently high so as to render the elements of said second assembly into a state whereby said elements of said second assembly emit ions of the other polarity;

(e) said first and second assemblies being arranged parallel and near of each other with all of the sharp ends of said elements directed to the same side so that an ion plasma is produced between the elements of said first assembly and the elements of said second assembly; and (f) means for applying sound waves onto the ion plasma so that the ionization potential difference applied to said elements is modulated by a low frequency voltage which analogically reproduces the sound waves.

7. Electro-acoustic transfucer device as claimed in claim 6 wherein said elements with each having a sharp end of said first assembly are points, blades or filaments.

8. Electro-acoustic transducer device as claimed in claim 6 wherein said elements with each having a sharp end of said second assembly are points, blades or filaments.

9. Electro-acoustic transducer device as claimed in claim 6 wherein said first and second assemblies each comprise a plurality of elongated curved or linear sub-assemblies of said elements each having a sharp end, a sub-assembly of one of said assemblies being disposed between two sub-assemblies of the other of said assemblies.

10. Electro-acoustic transducer device as claimed in claim 9 wherein an insulating screen is inserted between two adjacent sub-assemblies of opposite polarity, parallel thereto and whose length is slightly greater than that of said elements so that they project beyond the ends thereof.

11. Electro-acoustic transducer device as claimed in claim 10 wherein the length h by which the screens project beyond the ends of the sharp elements is of the same order of size as the distance d between two consecutive sub-assemblies.

12. Electro-acoustic transducer device as claimed in claim 9 wherein said sharp elements are points arranged in constituting sub-assemblies in the form of combs.

13. Electro-acoustic transducer as claimed in claim 9 wherein said sharp elements are disposed in concentric circles which are separated by concentric circular insulating screens.

* * * * *